United States Patent [19]

Barnes et al.

[11] 4,109,593

[45] Aug. 29, 1978

[54] MACHINE FOR MAKING A TEXTILE PRODUCT

[75] Inventors: William John Barnes, Disley; Barry John Belcher, Reading; John Kenneth Harvey, London, all of England

[73] Assignee: Newroyd Limited, England

[21] Appl. No.: 772,839

[22] Filed: Feb. 28, 1977

[30] Foreign Application Priority Data

Mar. 4, 1976 [GB] United Kingdom ..... 8752/76

[51] Int. Cl.[2] ..... D05C 15/30

[52] U.S. Cl. ..... 112/79 A; 112/221

[58] Field of Search ..... 2/79 A, 79 FF, 80, 79 R, 2/98, 102, 221, 262, 121.12, 121.11, 121.15

[56] References Cited

U.S. PATENT DOCUMENTS

| | | | |
|---|---|---|---|
| 514,138 | 2/1894 | Spengler | 112/98 |
| 2,499,178 | 2/1950 | Berry et al. | 112/102 X |
| 2,528,392 | 10/1950 | Self | 112/79 R |
| 2,649,064 | 8/1953 | Durnschmidt | 112/98 X |
| 2,679,620 | 5/1954 | Berry | 112/102 X |
| 3,450,076 | 6/1969 | Bender | 112/79 R |

*Primary Examiner*—H. Hampton Hunter

*Attorney, Agent, or Firm*—Anthony J. Casella; Joseph A. Calvaruso

[57] ABSTRACT

A machine for making a textile product comprising a rotatably mounted needle carrier shaft which is arranged to be set in a plurality of predetermined angular positions, yarn feeding means for feeding at least one yarn to a needle carried by said shaft, means for reciprocating the said needle carrier shaft so that the said yarn may be applied to a base material, and control means which are arranged to be programmed to rotate the said needle carrier shaft to the said predetermined angular positions.

17 Claims, 13 Drawing Figures

Figure 1A:
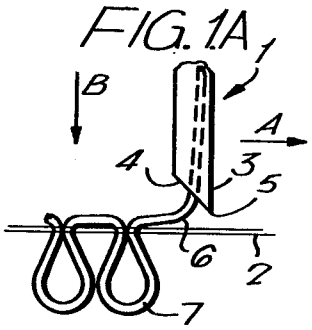

DEMAND ANGLE
CLOCKWISE CLUTCH
LOGIC
POWER DRIVERS
COUNTER-CLOCKWISE CLUTCH
BRAKE
OSCILLATOR
CONTROL LOGIC
COUNTER
GATE
STORE

0° 45
90
135
180
225
270
315
360

MACHINE FOR MAKING A TEXTILE PRODUCT

This invention concerns a method and a machine for making a textile product and although the invention is not so restricted it is more particularly concerned with a method and a machine for making a tufted fabric such for example as a tufted carpet or rug.

Machines previously known for producing tufted fabrics have been provided with a machine head having a multiplicity of tufting needles, and have therefore been of complex design.

Conventional multi-needle tufting machines, moreover, have been restricted in the design and decorative content of their products by the fixed gauge (i.e. distance between the needles) and by the fact that the needles can only produce rows of yarn loops in one direction.

Conventional multi-needle tufting machines have also been high volume, mass production machines for which a very large quantity of backing material and yarn must be fed to the machine. Consequently, machine changeovers from one product to another are very costly and the minimum economic size of an order is a very large quantity of tufted fabrics.

According to the present invention, there is provided a machine for making a textile product comprising a rotatably mounted needle carrier shaft which is arranged to be set in a plurality of predetermined angular positions, yarn feeding means for feeding a yarn or yarns to a needle carrier by said shaft, means for reciprocating the said needle carrier shaft so that the said yarn or yarns may be applied to a base material, and control means which are arranged to be programmed to rotate said needle carrier shaft to the said predetermined angular positions.

In the case of the machine of the present invention, therefore, it is economic to produce "one-off" or very small orders. Since the machine can easily be programmed to change the pattern, it is capable of producing "made-to-order" products of high quality using design effects not previously available to the tufting manufacturer. However, in the case of the present invention, the machine can vary the gauge (i.e. the space in between the rows of yarn loops) and can produce rows of yarn loops in any required direction. Consequently, the machine of the present invention can produce decorative effects which are not possible with conventional tufting machines.

Preferably, the control means is responsive to the rate of reciprocation of the needle carrier shaft.

In operation, the control means preferably compares the actual angular position of the said needle carrier shaft with a said predetermined angular position and rotates the said needle carrier shaft to the said predetermined angular position in the event of any departure therefrom.

Electro-optical means may be provided for producing signals indicating the actual angular position of the said needle carrier shaft. The said electro-optical means may comprise at least one light source and light detector, and a mask which is interposed between the or each light source and light detector and whose angular position is determined by that of the needle carrier shaft, the mask differentially occluding the light in dependence upon its angular position so that the light detector or detectors produce a signal or signals related to said angular position.

First and second drive means may be provided for respectively rotating the needle carrier shaft in opposite angular directions, the first and second drive means respectively comprising first and second clutches which are controlled by said control means.

The control means may also control a brake for preventing rotation of the needle carrier shaft.

The first and second drive means may themselves be driven from a common drive shaft.

The needle carrier shaft may be mounted in a head, traversing means being provided for traversing said head, the said control means adjusting the angular position of the needle carrier shaft in dependence upon the direction in which the head is being traversed.

The traversing means preferably has first and second traverse mechanisms for respectively traversing the head in orthogonal directions, each traverse mechanism comprising a servo motor having a shaft which is arranged to be rotated in oppposite angular direction, a respective carriage which is connected to said head and is arranged to be moved linearly, and at least one respective cable or belt which engages the motor shaft and which is connected to the respective carriage so that rotation of the motor shaft in opposite angular directions respectiely causes the or each cable or belt to be moved so as to effect traversing movement of the respective carriage in opposite linear direction. Preferably the carriage of one of the said traverse mechanisms is movable over the carriage of the other traverse mechanism.

The term "cable" as used herein in a broad sense to include wires, ropes, chains and the like, while a belt if used, may be a toothed belt.

In at least one of the said traversing mechanisms, there may be two cables or belts, or two portions of a common cable, or belt, which respectively, extend from the motor shaft to spaced apart parts of the carriage, rotation of the motor shaft in either angular direction causing the two cables or belts or cable or belt portions to move simultaneously in opposite directions.

The control means may be arranged to control the operation of the traverse motors in dependence upon the speed of reciprocation of the needle carrier shaft.

The machine preferably comprises an electrical servo-motor for driving the yarn feeding means, the control means being arranged to control operation of the yarn feeding servo motor in dependence upon a predetermined programme, the control means being responsive to the speed of reciprocation of the needle carrier shaft.

The control means may also be responsive to the extent to which the head has moved from a datum position.

The needle carrier shaft is preferably hollow, the yarn feeding means comprising means for passing a flow of fluid through the interior of the needle carrier shaft so as to entrain the yarn therethrough.

Means are preferably provided for interrupting the said flow of fluid through the interior of the needle carrier shaft during a part only of the reciprocation of the latter.

Thus there may be a chamber through which passes the needle carrier shaft or a shaft secured thereto, the needle carrier shaft or shaft secured thereto having an aperture in the wall thereof which establishes communication between the interior thereof and the said chamber during a part only of the reciprocation of the needle carrier shaft, and means for supplying the chamber with the said fluid.

The yarn feeding means may comprise a serrated roller, and means for passing the yarn in contact with said roller.

The control means may alternatively comprise a stepping motor, e.g. a stepping motor having a plurality of windings, each of which, or each combination of which, when energised, causes the needle carrier shaft to rotate to and to be held in a respective predetermined position.

The invention also comprises a method of making a textile product comprising feeding a yarn or yarns to a needle carried by a rotatably mounted needle carrier shaft, reciprocating the needle carrier shaft so as to apply the yarn or yarns to a base material, effecting relative movement between the needle and the base material in the plane of the latter, periodically changing the direction of the said relative movement and, at each such change in direction, rotating the needle carrier shaft so that the needle tip always faces forwardly.

The textile product may be a tufted product. Alternatively, the needle may be used to effect sewing or embroidery.

The invention also comprises a textile product when made by the said machine or method.

As will be provided, in the case of a machine according to the present invention it is not necessary to provide the head with a multiplicity of tufting needles since the head, even though provided with a single tufting needle, may be moved as required over the backing material.

Figure 1B:
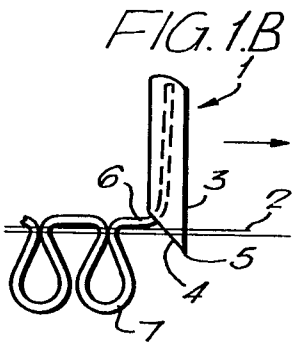
Figure 1C:
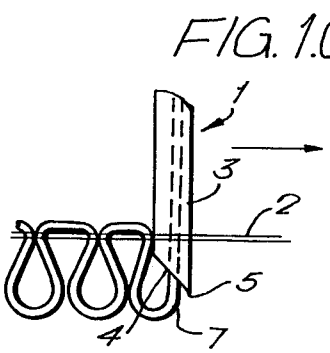
Figure 2A:
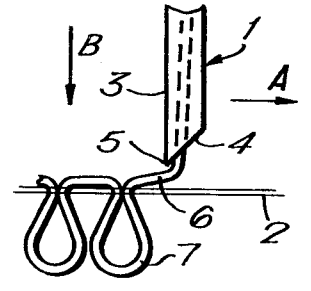
Figure 2B:
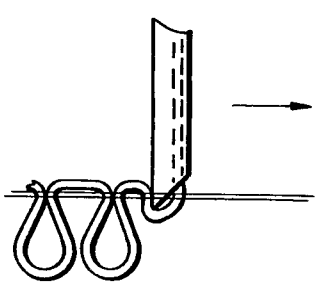
Figure 2C:
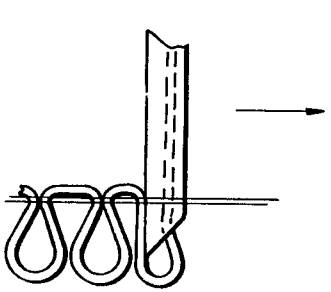
Figure 3:
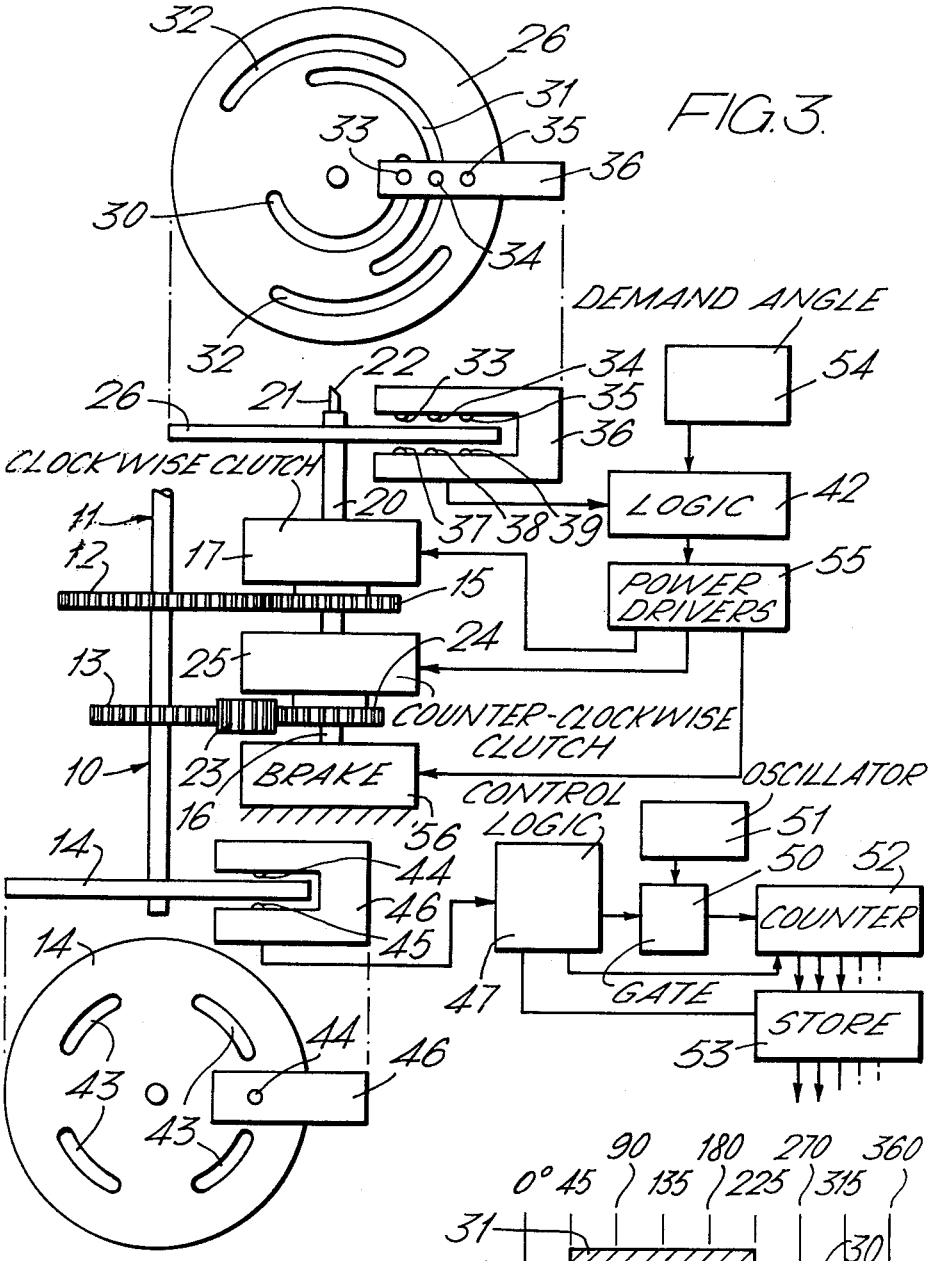
Figure 4:
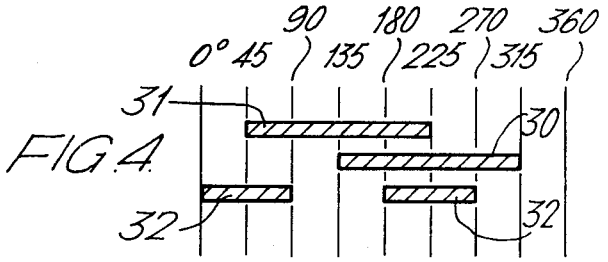
Figure 5:
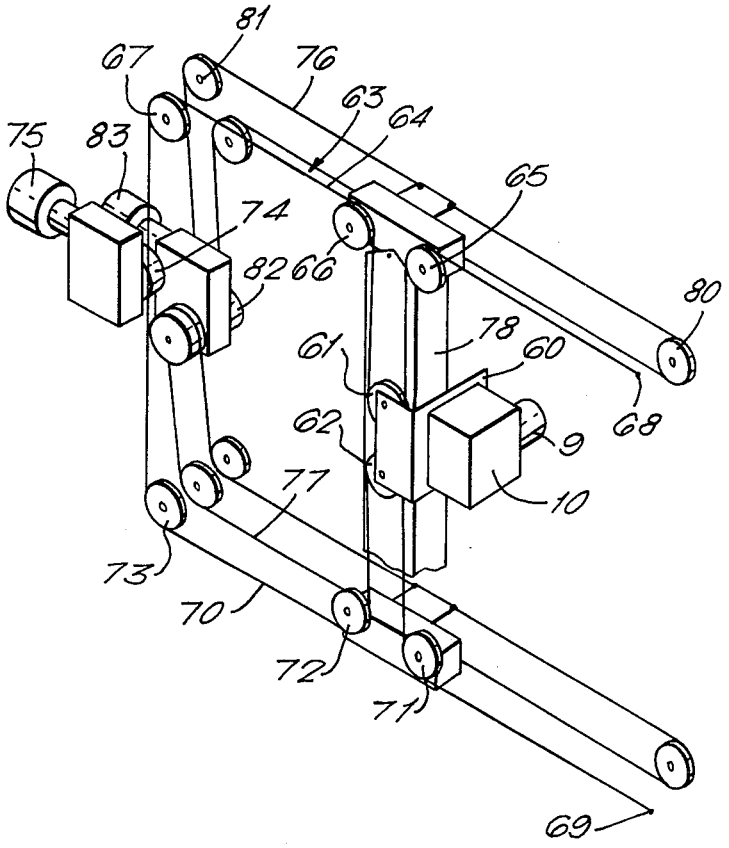
Figure 6:
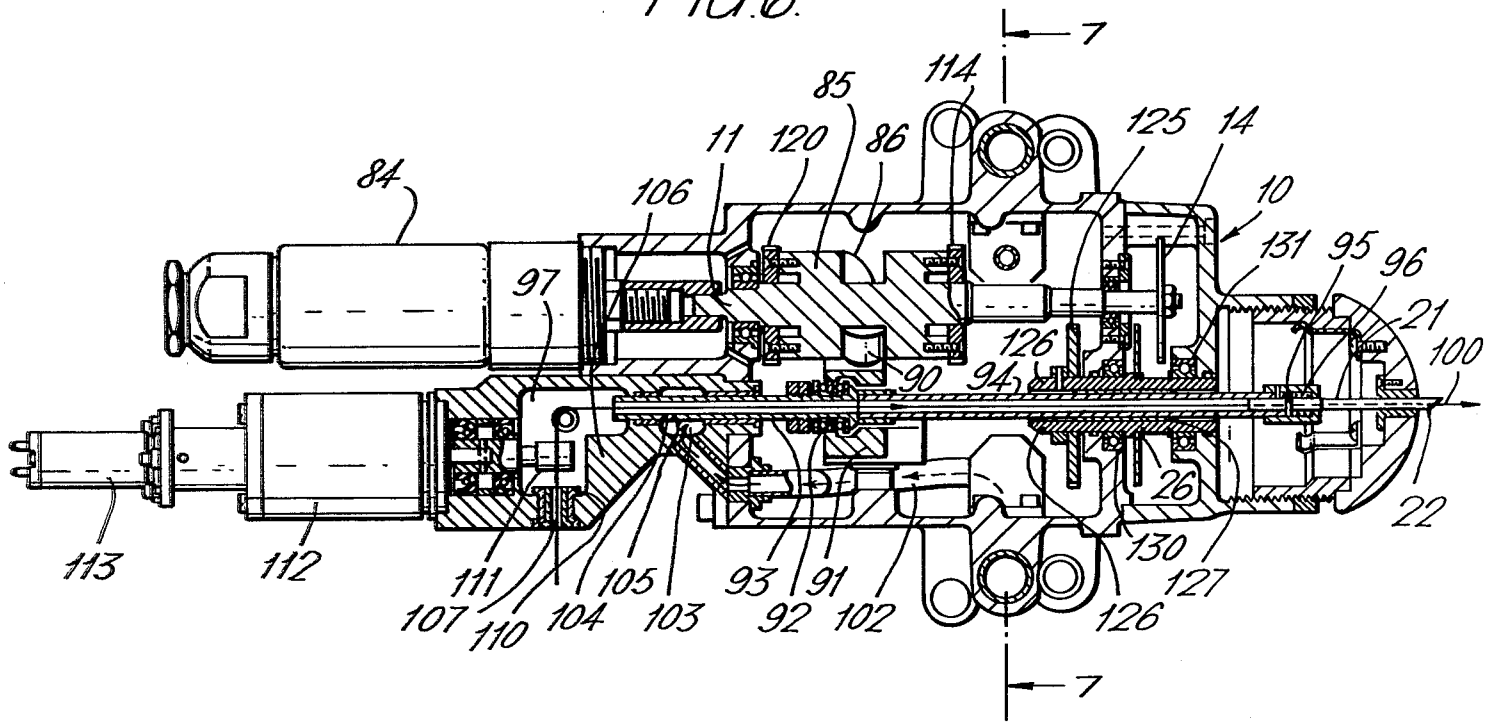
Figure 7:
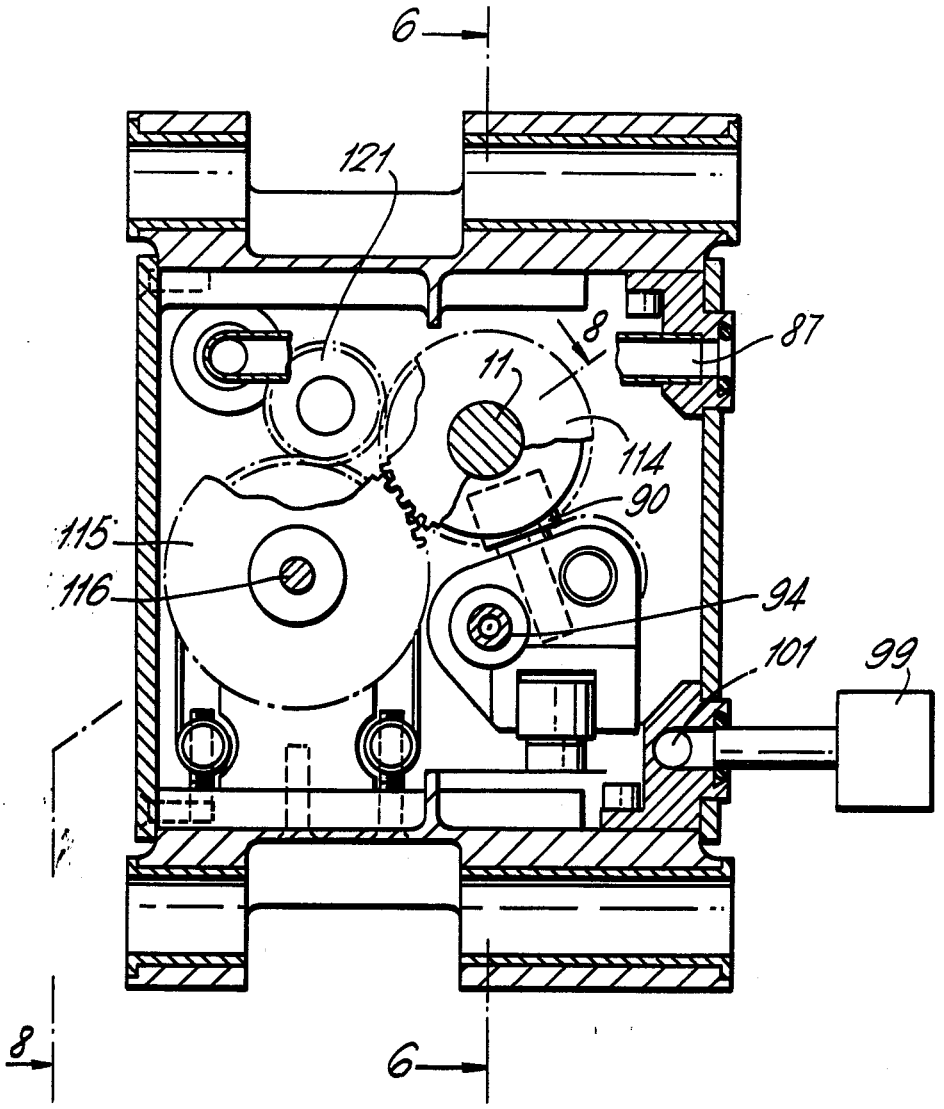
Figure 8:
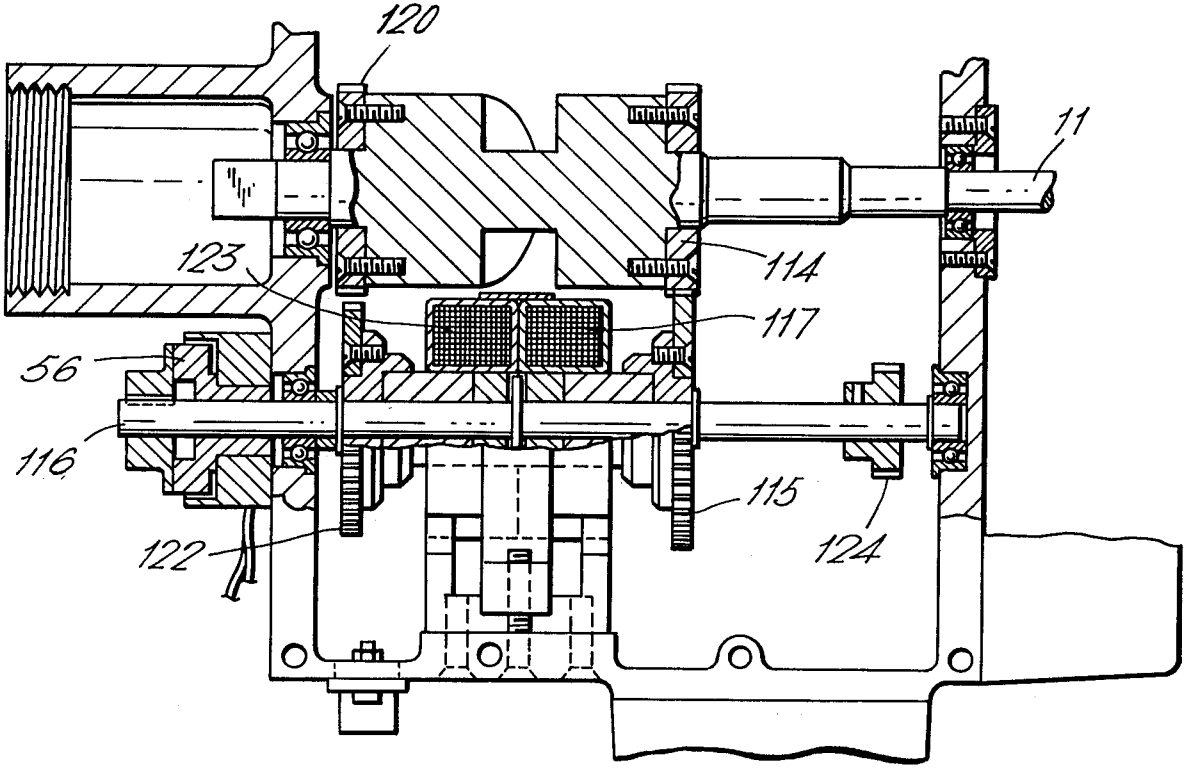
Figure 9:
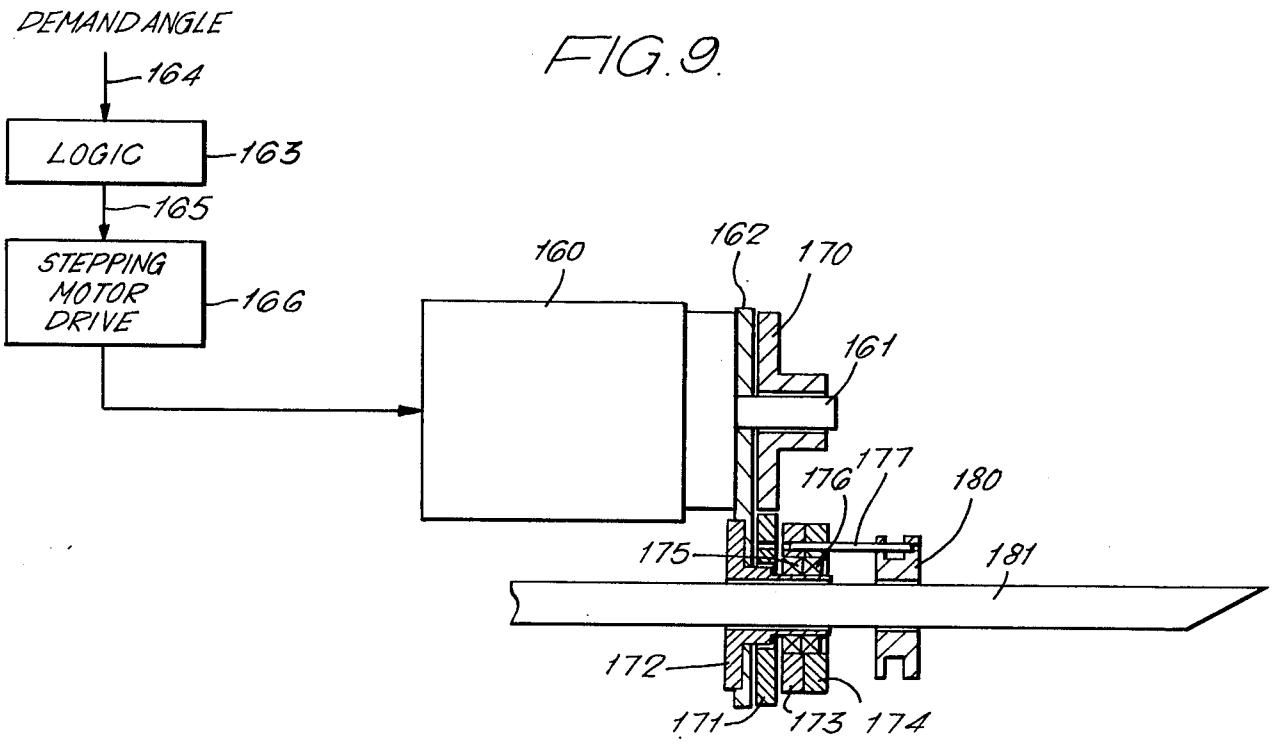

The invention is illustrated, merely by way of example, in the accompanying drawings, in which:

FIGS. 1A, 1B, 1C respectively illustrate diagrammatically three successive positions of a tufting needle having a leading needle tip, FIGS. 2A, 2B, 2C respectively illustrate diagrammatically three successive positions of a tufting needle having a trailing needle tip, FIG. 3 is a diagram illustrating a machine for making a textile product according to the present invention, FIG. 4 is a diagram showing a Gray binary code which may be used in connection with the determination of the angular position of a needle of the machine of FIG. 3, FIG. 5 is a diagrammatic perspective view of a traverse mechanism for traversing a head of the said machine, FIG. 6 is a sectional view of one embodiment of a said head taken on the line 6—6 of FIG. 7, FIG. 7 is a section taken on the line 7—7 of FIG. 6, FIG. 8 is a section taken on the line 8—8 of FIG. 7, and FIG. 9 is a cross-sectional view of a further embodiment of the invention.

Terms such as "upper", "lower", "left", "right", "horizontal", "vertical", "clockwise" and "counterclockwise", as used in the description below, are to be understood to refer to directions as seen in the accompanying drawings.

In FIGS. 1A, 1B, 1C there are shown three successive positions of a tufting needle 1 of a machine for making a tufted fabric, the tufting needle 1 being continuously moved horizontally over a stationary base material 2 as indicated by an arrow A and being continuously reciprocated vertically towards and away from the direction indicated by the arrow B. As will be appreciated, if the needle 1 is to pierce the base material 2, it must have a sharp vertical edge 3 and an oblique edge 4 leading to a needle tip 5. When the needle 1 is arranged as shown in FIG. 1A, the vertical edge 3 is the leading edge and the oblique edge 4 is the trailing edge with the result that the needle tip 5 is disposed at the leading edge of the needle 1. Consequently, when the needle 1 moves in the diection of the arrow B, so as to form a fresh loop, there is no danger of the needle tip 5 engaging the length of yarn 6 which is disposed between the needle 1 and the last of the already formed loops 7, such danger being absent since the needle tip 5 is in this case disposed forwardly of the length of yarn 6.

If, on the other hand, the needle 1 is arranged as shown in FIG. 2A, the vertical edge 3 is the trailing edge, and the oblique edge 4 is the leading edge. Consequently, when the needle 1 moves in the direction of the arrow B so as to form a fresh loop, the length of yarn 6 is engaged by the needle tip 5 and is liable to become trapped between the needle tip 5 and the base material 2 and this may prevent the needle 1 from passing properly through the base material 2. Moreover, although the needle 1 may pass through the base material 2, the engagement between the needle tip 5 and the length of yarn 6 is liable to cause damage to the latter, while the engagement between the needle tip 5 and the length of yarn 6 will make it impossible to ensure that the loops are formed regularly or are maintained at regular positions.

Consequently, it is essential that the needle tip 5 always faces forwardly with regard to the direction A i.e. that it always faces forwardly with respect to the direction of relative horizontal movement of the needle 1 with respect to the base material 2.

In the machine for making a tufted fabric according to the present invention the tufting needle 1 is carried by a head 10 whose construction is shown in FIG. 5 and described in detail below. The head 10 is arranged to be continuously driven, as described below, in orthogonal directions over the base material 2 so that by the use of one single continuously driven head 10 having a single continously reciprocated needle 1, the needle 1 may be continuously reciprocated into and out of all parts of the base material 1 which are to be provided with tufts of yarn. Such continuous movement of the head and needle is possible because the base material is sufficiently extensible to allow for the traversing motion of the needle therethrough. The hole made by the needle in the base material is of course extended by this traversing movement during the time that the needle extends through the base material, but once the needle is retracted out of the base material, the latter recovers and contracts to fit closely around the yarn which has been introduced thereinto.

In the case of the machine of the present invention, therefore, the needle 1 is traversed horizontally over the base material 2 in any required direction and consequently, whenever this direction is changed, it is necessary to rotate the needle to that the needle tip 5 is always at the leading edge of the needle with respect to the direction of travel. In the machine of the present invention this is achieved by the construction described below.

FIGS. 3 to 5 illustrate diagrammatically a machine according to the present invention for making a tufted fabric such, for example, as a tufted carpet or rug. The head 10 comprises a motor shaft 11 on which are mounted gears 12, 13, and a metal, light-masking disc 14, for rotation thereby. The gear 12 meshes with a freely rotatable gear 15 which is adapted to be drivingly connected to a shaft 16 by means including a "clockwise" clutch 17 such that, when the "clockwise" clutch 17 is engaged, the shaft 16 is rotated clockwise on counter-clockwise rotation of the motor shaft 11. The shaft 16 drives a needle carrier shaft 20 which is reciprocated by the motor shaft 11 (by means not shown in FIG. 3) and is provided with a rotatably mounted tufting needle 21 having a pointed leading end 22, which is arranged to be set in a plurality of predetermined angular positions.

The gear 13 meshes with a pinion 23 which itself meshes with a freely rotatable gear 24. The latter is adapted to be drivingly connected to the shaft 16 by means including a "counter-clockwise" clutch 25 such that, when the "counter-clockwise" clutch 25 is engaged, the shaft 16 is rotated counter-clockwise on counter-clockwise rotation of the motor shaft 11.

The shaft 20 drives a metal, light-masking disc 26 having concentric arcuate slots 30, 31, 32 of respectively increasing radius which are angularly staggered with respect to each other, there being two angularly spaced apart slots 32 the space between which is radially aligned with portions of the slots 30, 31. As will be seen from FIG. 3, there is a sector of the disc 26 into which none of the slots 30-32 extends. Infra-red light sources 33, 34, 35, e.g. light emitting diodes, are mounted in a common support member 36 in positions such that, when the disc 26 is appropriately angularly disposed, light from the light sources 33, 34, 35 may pass respectively through the slots 30, 31, 32 so as to fall onto photo-electric cells or other light detectors 37, 38, 39 respectively which are mounted on the support member 36. The infra-red light sources 33, 34, 35 may be separate, self-contained units.

The light detectors 37-39 pass signals to a logic or control circuit 42. As will be seen from FIG. 4, between 0° and 45° from a datum position of the disc 26, light will pass only through one of the slots 32 so that only the light detector 39 will produce a signal; between 45° and 90° light will pass through the slots 31, 32 so that there will be signals from the light detectors 37, 39 only; between 90° and 135° light will pass through the slot 31 only so that there will be a signal from the light detector 37 only; and so on. Consequently the disc 26 constitutes a mask which differentially occludes the light from the light sources 33-35 in dependence upon its angular position so that the light detectors 37-39 produce signals related to the said angular position. The disc 26, slots 30-32, light sources 33-35 and light detectors 37-39 thus collectively constitute an optical encoder for producing signals which are arranged in a Gray binary code and which are representative of the instantaneous angular position of the shaft 20 and hence of the angular position of the pointed leading end 22 of the tufting needle 21. As will be appreciated, if a plurality of angularly spaced apart support members 36 are provided, each carrying light sources 33 to 35 and light detectors 37-39, then the accuracy to which the angular position of the shaft 20 can be read by the said optical encoder can be improved. The accuracy can also be improved by increasing the number of slots in the disc 26, together with a corresponding increase in the number of light sources and light detectors.

The disc 14 is provided with a plurality of equi-angularly spaced apart concentric arcuate slots 43. In FIG. 3, four such slots 43 are shown, but other numbers are possible, e.g. 8 or 32. An infra-red light source 44 and a photo-cell or other light detector 45, are mounted on a support member 46 on opposite sides of the disc 14 and are at the same radial distance from the axis of the disc 14 as the slots 43. The light detector 44, at each revolution of the motor shaft 11, produces four pulses which are passed to a control logic circuit 47, of a control system, the frequency of these pulses being representative of the speed of the motor shaft 11 and hence of the rate of reciprocation of the shaft 20 and thus of the stitch rate. The control logic circuit 47 passes a signal to a gate 50 controlled by an oscillator 51, the signal from the gate 50 passing to a counter 52 and hence to a magnetic or other information store 53 which also receives signals directly from the control logic circuit 47. The output from the information store 53 is in the form of a digital pattern representing 1/N, where N is the speed of movement of the head 10 over the base material 2. The counter 52 is arranged to be switched on by a signal produced by a slot 42 in the disc 14 and to be switched off by a signal from the next, or some other, slot 43. Pulses from the oscillator 51 are counted between said signals and the value is put into the information store 53. Consequently, a count related to the reciprocating speed of the needle 21 is always available in the information store 53 for use by other parts of the control system.

As indicated above, the pointed end 22 should face forwardly with respect to the direction in which the head 10 is being moved at any time over the said base material 2. Since this direction is periodically changed as the head 10 is moved over the base material 2, it is necessary to effect corresponding changes in the angular disposition of the needle 21. This control of the angular disposition of the needle 21 is effected by the logic circuit 42 which compares the signals received from the light detectors 37-39, these signals being representative of the actual angular disposition of the needle 21, with a signal which is representative of a required angular disposition of the needle 21, the last-mentioned signal being derived from a demand angle circuit 54. The demand angle circuit 54 is itself controlled by a programme, e.g. on magnetic tape, which also controls the said movement of the head, the demand angle circuit 54, the means for moving the head 10, and the store 53 being electrically interconnected (by means not shown) to ensure that there is appropriate synchronisation of the movement of the head 10 over the base material in relation to the reciprocation of the needle 21, and that the needle 21 is appropriately angularly disposed in relation to the direction of movement of the head 10.

Signals from the logic circuit 42, resulting from any difference in value between the signals supplied thereto, are passed to power drivers 55 which control operation of the clutches 17, 25 and also control operation of a brake 56 which, when engaged, prevents rotation of the shaft 16.

When the angular disposition of the needle 21, as sensed by the light detectors 37-39, differs from the demand angle set by the demand angle circuit 54, a signal passes to release and brake 56 and another signal passes to engage the appropriate one of the clutches 17, 25. The needle 21 will then rotate in the required angular direction (depending on which of the clutches 17, 25 is engaged) until its angular disposition corresponds to that set by the demand angle circuit 54. When this occurs, signals pass to the previously engaged clutch, to release the latter, and to the brake 56, to effect engagement thereof. The needle 21 will then be held in its new angular position. The logic circuit 42 is so designed that the clutch 17, 25 which is engaged at any time is such that the needle 21 is rotated through the minimum angular distance to its new angular position.

The head 10 is carried by a carriage 60 (FIG. 5) which is arranged to be moved in two orthogonal linear directions. The head 10 is movable (by means not shown) over the carriage 60 so as to maintain an end portion 9 of the head 10 in contact with the base material (which is not shown in FIG. 5) so as to tension the latter during the introduction of the needle thereinto. The carriage 60 is provided with spaced apart upper and lower pulleys 61, 62. Each of the two cables 63 (only one shown), e.g. of wire, rope or plastics materials, has an upper cable portion 64 which is entrained over the upper pulley 61 and over pulleys 65, 66, 67, and a lower cable portion 70 which is entrained over the lower pulley 62 and over pulleys 71, 72, 73. The right hand ends of the cable portions 64, 70 are anchored at 68, 69 respectively. The cables 63 are wound about a motor shaft 74 of an electric servo motor 75 which can be rotated in either angular direction so that the cable portions 64, 70 are moved simultaneously in opposite directions. Thus if the motor shaft 74 is rotated clockwise, the cable portions 70 will be let out and the cable portions 64 will be simultaneously taken up, with the result that the carriage 60 will rise vertically. If, on the other hand, the motor shaft 74 is rotated counter-clockwise, the carriage 60 will descend vertically.

The carriage 60 is movable vertically over a carriage 78. The carriage 78 is secured at its upper and lower ends to an upper pair of cables 76 (only one shown), e.g. of wire, rope or plastics material, and to a lower pair of cables 77 respectively. The upper pair of cables 76 are entrained over pulleys 80, 81 and over a motor shaft 82 of an electric servo motor 83 which can be rotated in either angular direction so that the cables 76, 77 are moved simultaneously. Thus the carriage 78 can be traversed towards the left and right by counter-clockwise and clockwise rotation respectively of the motor shaft 82.

The duplication of the cables 63, 70, 76, 77 is provided to ensure that the machine will not be damaged if a cable breaks. Means, not shown, are however provided such that, if a said cable breaks or if its tension is outside a predetermined, and preferably adjustable, range, the machine is stopped.

The cables may, if desired, be replaced by belts, e.g. driving belts provided with driving teeth.

The servo motors 75, 83 are controlled, in dependence upon the speed of reciprocation of the needle carrier shaft 20, (by means not shown) by the count stored in the information store 53 and by the said magnetic tape or other control so that they can effect movement as required of the carriage 60 in the orthogonal directions, whereby the head 10 may be moved to all required parts of the base material.

A practical embodiment of a head 10 is shown in FIGS. 6 to 8. This embodiment resembles that of FIG. 3, like reference numerals indicating like parts.

As shown in FIGS. 6 to 8, the motor shaft 11 is driven by a compressed air motor 84 and carries a cam 85 having a cam track 86. The air for the air motor 85 is supplied through a pipe 87 (FIG. 7). If desired, however, the air motor 84 may be replaced by an electric motor (not shown). A cam roller 90 is mounted in the cam track 86 and is carried by a pusher member 91 so that rotation of the motor shaft 11 causes linear reciprocation of the pusher member 91. The pusher member 91 carries a thrust bearing 92 in which is rotatably mounted a hollow shaft 93, the hollow shaft 93 being coaxial with and secured to a hollow shaft 94. The left hand end of the needle 21 is mounted in the hollow shaft 94, the needle 21 having a flange 95 which is urged by a spring 96 into driving contact with the right hand end of the hollow shaft 94. Thus rotation of the motor shaft 11 produces reciprocation of the needle 21 so that tufting yarn 100, which has been fed, by means described below, to the pointed leading end 22 may be passed through the base material 2, to produce tufts therein.

As in the FIG. 3 construction, the speed of rotation of the motor shaft 11 is sensed by the optical encoder which includes the disc 14. The use of this optical encoder and associated electronic equipment provides a method of timing for the whole system. A timing function of this sort is important because of variations in the starting and stopping of the machine, and because use may be made of means (not shown) for varying the needle speed when the direction of travel of the head 10 changes by the large angle. Thus the traverse rate for the motors 75, 83 and the yarn feed rate may be calculated for a required tuft interval and pile height, and then adjusted for any variation in the needle speed in order to maintain a constant product.

Yarn feed air, from a compressed air source 99, is supplied to a conduit 101 and passes thence via a conduit 102 to a chamber 103 through which the hollow shaft 93 passes. The wall of the hollow shaft 93 is provided with an aperture 104 therethrough which, when the parts are disposed as shown in FIG. 6, establishes communication between the chamber 103 and the interior of the hollow shaft 93. Thus, in operation, air will pass from the chamber 103 to the interior of the hollow shaft 93 except when, during each reciprocation of the hollow shaft 93, it moves to the left of the position shown, when the aperture 104 will be sealed by a bush 105 mounted in a machine frame 106 within which the hollow shaft 93 is mounted. Thus the air to the interior of the hollow shaft 93 is shut off throughout at least a portion of the time during which the needle 21 does not extend through the base material.

The yarn 100 passes through a narrow opening 107 in a thread inlet member 110 mounted in the frame 106, the width of the narrow opening 107 being designed to admit the yarn 100 but to minimise air loss therethrough. The yarn 100 passes through the nip between a serrated yarn feed roller 111 and another roller (not shown) which are mounted in a chamber 97, and thence passes successively through the hollow shafts 93, 94 and through the hollow needle 21, and thus out through the pointed leading end 22 of the latter, the yarn being in operation propelled therethrough by the flow of compressed air.

If desired, the yarn feed air, instead of being supplied to the chamber 103 and so to the interior of the hollow shaft 93 by way of the aperture 104, could be supplied to the chamber 97 so as to pass directly into the left hand end of the hollow shaft 93, or so as to pass thereinto via a valve (not shown) which controls the air flow to the needle 21 so that the air to the latter is shut off throughout at least a portion of the time during which the needle does not extend through the base material.

The length, or height, of the yarn per tuft is controlled by a servo-motor 112 and tachometer 113, the servo-motor 112 driving the yarn feed roller 111 and thus pulling the yarn through the opening 107. The servo-motor 112 receives signals, by means not shown, both from the information store 53 and from the said tape control so that the yarn feed roller 111 is driven at a speed such as to produce a controlled continuously variable pile height, a constant pile height, or a pile height changing in steps, whichever is required. The tachometer 113 senses the value of the actual speed of the servo-motor 112 and this value is compared (by means not shown) with a pre-set value in order to produce the signals transmitted to the servo-motor 112.

The motor shaft 11 is provided with a gear 114 (corresponding to the gear 12 of FIG. 3 but in a different position on the motor shaft 11) which meshes with a gear 115 (FIG. 7) (corresponding to the gear 15). The gear 115 is freely rotatable on a shaft 116 but is clutched thereto on actuation of a clutch 117. The motor shaft 11 is also provided with a gear 120 (corresponding to the gear 13 of FIG. 3 but in a different position on the motor shaft 11) which meshes with a pinion 121 (FIG. 7), the pinion 121 in turn meshing with a gear 122 (FIG. 8). The gear 122 is freely rotatable on the shaft 116 but is clutched thereto on actuation of a clutch 123.

Mounted on the shaft 116 is a gear 124 which meshes with a gear 125, the gear 125 being fixed to a cylindrical member 126 which is rotatably mounted in the frame 106 by means of bearings 130, 13. The cylindrical member 126 carries the disc 26 of the optical encoder for determining the angular position of the needle 21, the hollow shaft 94 having a portion of its outer periphery which is square in cross-section and which extends slidably through a square cross-section sleeve 127, the sleeve 127 being mounted within a square cross-section hole in the cylindrical member 126 and engaging the latter. The shaft 116 is arranged to be braked by the brake 56.

The arrangement is thus such that if the motor shaft 11 is rotated clockwise and the clutch 117 is engaged, the hollow shaft 94, and hence the needle 21, will also be rotated clockwise, whereas if the motor shaft 11 is rotated clockwise and the clutch 123 is engaged, the needle 21 will be rotated counter-clockwise.

In operation, therefore, the hollow shaft 94, which carries the needle 21, is slidingly reciprocated within the sleeve 127 by virtue of the drive from the cam 85. When, however, appropriate signals are sent to the clutches 117, 123 and brake 56, the cylindrical member is rotated through the shortest angular distance to a different angular position, and this rotation of the cylindrical member 126 is transmitted to the needle 21 by way of the sleeve 127.

If desired, the head 10, instead of being driven over the base material by a traverse mechanism, could be moved by hand thereover. In this case, the head is provided with control means (not shown) which are arranged to be programmed to rotate the needle to predetermined angular positions, the control means being responsive to the direction in which the head is being moved over the base material.

The head 10 may, if desired, be one of a number of heads 10 which are respectively provided with different yarns and/or with different needles (which may, or may not, have different extents of reciprocation). The yarns may be of different materials, and/or of different colours, and/or of different sizes, and/or of different characteristics. In this case, each head 10 may be movable from a respective inoperative, or storage position to a common operative position in which it can be operated to effect tufting, latching means (not shown) being provided for releasably retaining each head in the operative position.

Alternatively, instead of operating one head at a time, there may be plurality of heads which are operated simultaneously from a common electronic control panel (not shown). For example, each head may have a respective traversing mechanism therefor and may execute the same pattern.

If desired, the disc 14 may be used to provide an indication of the position, at any moment, of the needle within its stroke, e.g. to indicate when the needle is at one end of its reciprocation. This may be achieved by providing the disc 14 with apertures additional to the slots 43 and with corresponding additional parts 44, 45.

If desired, the clutches 117, 123 of FIG. 8 may be replaced by a stepping motor which may be geared, either directly or through a gear train, to the cylindrical member 126. In this case, the said stepping motor may be controlled either by the optical encoder which includes the disc 26, or by some other means responsive to the angular position of the needle 21.

One particular stepping motor drive which may be used to effect the required angular positioning of the needle 21 is illustrated in FIG. 9.

In FIG. 9 there is shown a stepping motor 160 having a plurality of windings (not shown) each of which, or each combination of which, when energised, causes a shaft 161 to rotate to and to be held in a respective predetermined angular position. The shaft 161 extend through a mounting plate 162 on which the stepping motor 160 is mounted.

The energisation of the windings of the stepping motor 160 is effected by an electrical control system which includes a logic circuit 163 having an input 164 which is representative of the predetermined angular position, and an output 165 which is fed to a stepping motor drive 166 which drives the stepping motor 160. The input 164 to the logic circuit 163 will be successively adjusted, in accordance with a predetermined programme, so as to cause the stepping motor 160 to successively rotate the shaft 161 to the appropriate angular positions at the correct moments in said programme.

Mounted on and fixed to the shaft 161 is a driving gear 170 which meshes with a driven gear 171. The driven gear 171 is rotatably mounted on a sleeve member 172 which is fixed to the mounting plate 162, the driven gear 171 being secured (by means not shown) to a hub member 173. The hub member 173, and a driven disc 174 to which the hub member 173 is fixed, are rotatably mounted, by way of bearings 175, 176 respectively on the sleeve member 172. The driven gear 171, hub member 173, and driven disc 174 have aligned holes which are arranged to receive a reciprocating drive pin 177. The drive pin 177 is fixed to a bobbin or pusher 180 which is itself secured to a shaft 181. The shaft 181 is constituted by or is drivingly connected (by means not shown) to the needle shaft.

The angular displacement of the shaft 161 which is effected by the stepping motor 160 is transmitted by the driving gear 170 and driven gear 171 to the drive pin 177 and hence to the shaft 181. At the same time, the reciprocation of the shaft 181 is permitted by virtue of the ability of the drive pin 177 to reciprocate in the holes in the parts 171, 173, 174.

The stepping motor 160 is of a type such as to eliminate the need for a positional encoder since it will rotate the shaft 181 to a definite angular position in accordance with which of its particular windings have been energised, no feed back information of the needle position being required.

It would, however, also be possible to replace the stepping motor 160 by a D.C. motor (not shown). If this is done, it is necessary to use a brake to hold the shaft 161 (or the shaft 181) in the required position, and an encoder to provide feed back information with respect to the position of the needle.

The present invention is applicable not merely to a machine which produces a tufted fabric by the method illustrated in FIG. 1, but equally to a known machine for producing a tufted fabric which incorporates a looper (not shown). Such a looper is disposed on the side of the base material 2 adjacent the loops 7 and is arranged to reciprocate parallel to the base material 2 and into and out of engagement with each newly formed loop 7 so as to assist in its formation. If the invention is applied to such a machine, it is necessary to rotate the looper as required to the same angular position as to the needle, while it is also necessary to rotate the needle to ensure that the plane of the needle always lies in the direction of the traverse of the needle and thus faces forwardly.

The present invention is also applicable to a known machine which produces cut pile tufting and which, in addition to the said looper, is also provided, on the side of the base material adjacent the loops 7, with a knife which reciprocates towards and away from the base material 2 and thus towards and away from a position in which it cuts a loop or loops held by the looper. If the invention is applied to such a machine it would, of course, be necessary to rotate both the looper and the knife to the same angular position as the needle, while it is also necessary to rotate the needle to ensure that the plane of the needle always lies in the direction of the traverse of the needle and thus faces forwardly.

The invention is applicable to the production of textile fabrics of all kinds, e.g. woven fabrics, knitted fabrics, needled fabrics and spun bonded fabrics.

The needle employed in the present invention, instead of being used to effect tufting, may be used to effect sewing, e.g. the stitching of two or more fabrics together, or may be used to effect embroidery, e.g. the stitching of a decorative yarn onto a base fabric. Such sewing or embroidery would involve the use of needles on opposite sides of the base material, each such needle being rotated when necessary to ensure that its leading end is always correctly disposed.

We claim:

1. A machine for making a textile product comprising a head, a rotatably mounted needle carrier shaft which is carried by said head and which is arranged to be set in a plurality of predetermined angular positions around the longitudinal axis thereof, yarn feeding means for feeding at least one yarn to a needle carried by said shaft, a first motor for driving the yarn feeding means, reciprocating means for reciprocating the said needle carrier shaft so that the said yarn may be applied to a base material, second and third motors for respectively traversing said head in two orthogonal linear directions over the base material, and programmed control means which ensure at all times during production that a needle carried by the needle carrier shaft always faces forwardly with respect to the direction of movement of the head, the control means being controlled in dependence upon the speed of reciprocation of the needle carrier shaft, and the control means controlling the operation of the first, second and third motors in dependence both on said program and on said speed of reciprocation.

2. A machine as claimed in claim 1 in which, in operation, the control means compares the actual angular position of said needle carrier shaft with said predetermined angular position and rotates said needle carrier shaft to said predetermined angular position in the event of any departure therefrom.

3. A machine as claimed in claim 2 in which electro-optical means are provided for producing signals indicating the actual angular position of said needle carrier shaft.

4. A machine as claimed in claim 3 in which the electro-optical means comprises at least one light source and light detector, and a mask which is interposed between each light source and light detector and whose angular position is determined by that of the needle carrier shaft, the mask including means for differentially occluding the respective light in dependence upon its angular position so that the light detector produces a signal related to said angular position.

5. A machine as claimed in claim 1 in which first and second drive means are provided for respectively rotating the needle carrier shaft in opposite angular directions, the first and second drive means respectively comprising first and second clutches which are controlled by said control means.

6. A machine as claimed in claim 1 in which the control means also includes and controls a brake for preventing rotation of the needle carrier shaft.

7. A machine as claimed in claim 5 in which the first and second drive means are driven from a common drive shaft.

8. A machine as claimed in claim 1 in which each of the second and third motors has a motor shaft which is arranged to be rotated in opposite angular directions, a respective carriage which is connected to said head and is arranged to be moved linearly, and at least one respective cable which engages the motor shaft and which is connected to the respective carriage so that rotation of the motor shaft in opposite angular directions respectively causes the cable to be moved so as to effect traversing movement of the respective carriage in opposite linear directions, movement of the said carriages being effected without movement of the second and third motors other than rotation of their respective motor shafts.

9. A machine as claimed in claim 8 in which the carriage of one of the said second and third motors is movable over the carriage of the other motor.

10. A machine as claimed in claim 8 in which associated with at least one of the second and third motors, there are two cables which respectively extend from the respective motor shaft to spaced apart part of the respective carriage, rotation of the motor shaft in either angular direction causing the two cables to move simultaneously in opposite directions.

11. A machine as claimed in claim 1 in which the control means is also responsive to the extent to which the head has moved from a datum position.

12. A machine as claimed in claim 1 in which the needle carrier shaft is hollow, the yarn feeding means comprising means for passing a flow of fluid through the interior of the needle carrier shaft so as to entrain the yarn therethrough.

13. A machine as claimed in claim 12 in which means are provided for interrupting said flow of fluid through the interior of the needle carrier shaft during a part only of the reciprocation of the latter.

14. A machine as claimed in claim 13 comprising a chamber through which passes the needle carrier shaft, the needle carrier shaft having an aperture in the wall thereof which establishes communication between the interior thereof and the said chamber during a part only of the reciprocation of the needle carrier shaft, and means for supplying the chamber with said fluid.

15. A machine as claimed in claim 1 in which the yarn feeding means comprises a serrated roller, and means for passing the yarn in contact with said roller.

16. A machine as claimed in claim 1 in which the control means comprises a stepping motor.

17. A machine as claimed in claim 16 in which the stepping motor has a plurality of windings which, when selectively energised, cause the needle carrier shaft to rotate to and to be held in a respective predetermined position.

* * * * *